United States Patent [19]

Jespers et al.

[11] 4,374,534

[45] Feb. 22, 1983

[54] TURBINE VENTILATOR COVER

[76] Inventors: Victor H. Jespers, 1001 Silverdale, Wichita, Kans. 67218; Douglas A. Hillen, 5960 B Mendocino Dr., Dallas, Tex. 75248

[21] Appl. No.: 188,780

[22] Filed: Sep. 22, 1980

[51] Int. Cl.[3] ..... B65D 37/00

[52] U.S. Cl. ..... 150/52 R; 52/3; 52/199

[58] Field of Search ..... 150/52 R, 52 A, DIG. 1; 52/3, 4, 5, 199, 219, 218, DIG. 14; 98/115 R; D23/163, 164

[56] References Cited

U.S. PATENT DOCUMENTS

| | | | |
|---|---|---|---|
| 2,815,809 | 12/1957 | Jacobs et al. | 52/3 X |
| 2,992,668 | 7/1961 | Collard | 150/52 R |
| 3,150,641 | 9/1964 | Kesh | 52/DIG. 14 |
| 3,654,049 | 4/1972 | Ausnit | 150/52 R |
| 3,951,160 | 4/1976 | Nitu | 52/5 |
| 4,306,390 | 12/1981 | Brown | 52/67 |

*Primary Examiner*—Leon Gilden

[57] ABSTRACT

A cover for covering a turbine ventilator has a cover body including a first body member having a first body edge and a first body base edge, and a second body member has a second body edge and a second body base edge. An internal seal is bound to a portion of the internal surface of the first body in proximity to the periphery of the first body edge; a first body base seal essentially circumscribes and is bound to a portion of the internal surface of the base of the first body in proximity to the first body base edge. A second body base seal similarly circumscribes and is similarly bound to a similar portion of the internal surface of the base of the second body as the first body and in general proximity to the second body base edge.

7 Claims, 4 Drawing Figures

FIG. 1
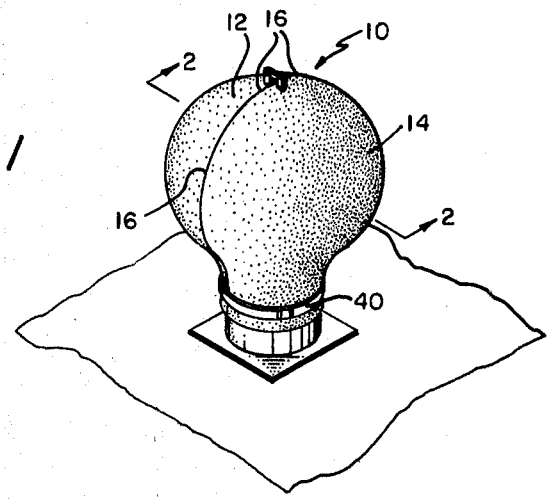
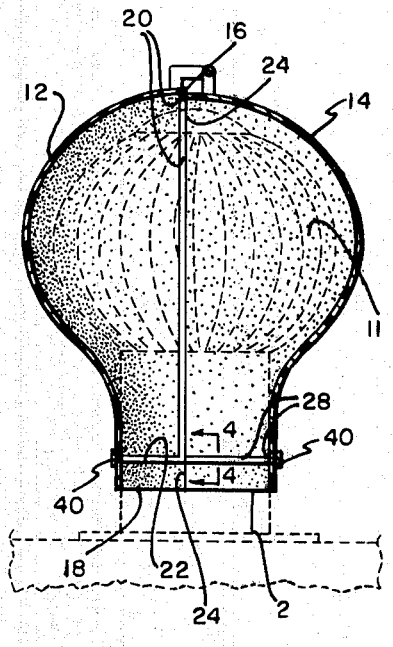
FIG. 2
FIG. 3
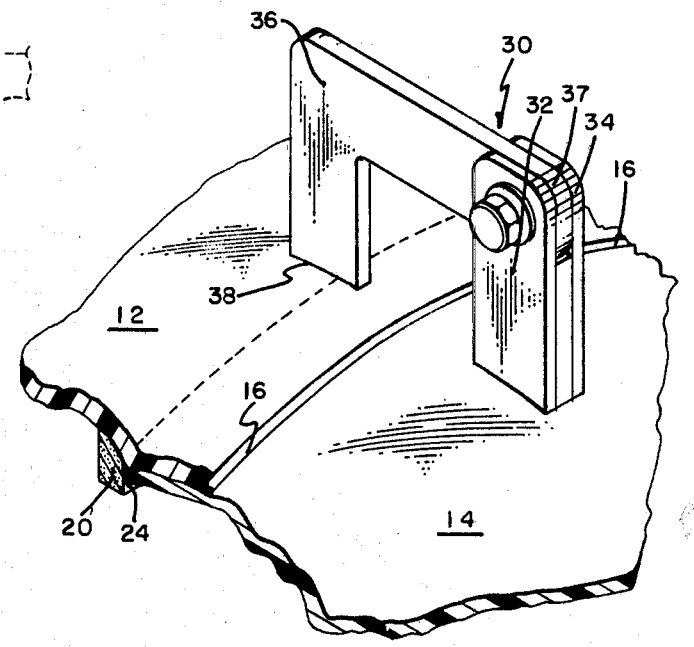
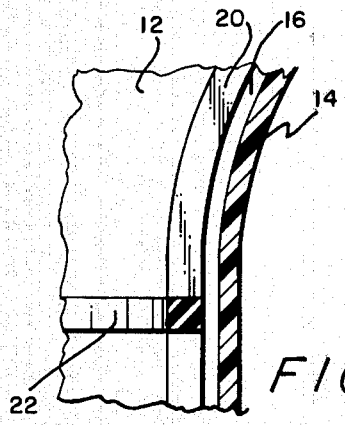
FIG. 4

TURBINE VENTILATOR COVER

BACKGROUND OF THE INVENTION

1. Field of the Invention

This invention is related to a turbine ventilator cover. More specifically, this invention provides a ventilator cover and process for covering a turbine ventilator or the like.

2. Description of the Prior Art

U.S. Pat. No. 4,168,726 by Klennert discloses a thermal boot apparatus for enclosing a test port and cap for a power house precipitator. U.S. Pat. No. 2,396,876 by Olsen teaches a flue cap protector or cover. None of the foregoing prior art teaches or suggests the particular turbine ventilator cover of the invention.

SUMMARY OF THE INVENTION

This invention accomplishes its desired objects by providing a cover and process for covering a turbine ventilator or the like comprising a cover body having a base. The cover body includes a first body member having a first body edge and a first body base edge; and a second body member having a second body edge and a second body base edge. A first body internal seal is bound to a portion of the internal surface of the first body in proximity to the periphery of the first body edge; and a first body base seal is essentially circumscribing and bound to a portion of the internal surface of the base of the first body in general proximity to the first body base edge. A second body base seal similarly circumscribes and is similarly bound to a similar portion of the internal surface of the base of the second body as the first body and is in general proximity to the second body base edge. The first body member, when combining with the second body member to enclose the turbine ventilator or the like to protect same from the weather, has the second body edge contacting the first body internal seal, and the first body base seal and the second body base seal join together to essentially seal the base of the cover body to the base of the turbine ventilator or the like.

It is an object of this invention to provide a turbine ventilator cover and process for covering a ventilator or the like.

Still further objects of the invention reside in the provision of a turbine ventilator cover which can be easily installed and is relatively inexpensive to manufacture.

These together with the various ancillary objects and features will become apparent as the following description proceeds, are attained by this ventilator cover, preferred embodiments being shown in the accompanying drawings, by way of example only, wherein:

BRIEF DESCRIPTION OF THE DRAWINGS

FIG. 1 is a perspective view of the invention installed around a turbine ventilator or the like;

FIG. 2 is a vertical sectional view taken in direction of the arrows and along the plane of line 2—2 in FIG. 1;

FIG. 3 is an exploded view of the L-shaped hinge providing pivotation for the first and second cover body members; and FIG. 4 is an enlarged vertical sectional view taken in direction of the arrows and along the plane of line 4—4 in FIG. 2.

DETAILED DESCRIPTION OF THE INVENTION

Referring in detail now to the drawings wherein similar parts of the invention are identified by like reference numerals, there is seen a turbine ventilator cover, generally illustrated as 10, for enclosing a turbine ventilator 11 and manufactured of any ridged material (eg. plastic polymers or the like) which would be weatherproof and safe. The cover 10 comprises a first body member 12 and a second body member 14. Body member 12 has a first body edge 16, a first body base edge 18, and an internal seal 20 (preferably a rectangular ridge) generally traversing and bound to a portion of the internal surface of the first body 12 and in proximity to the periphery of the first body edge 16 (see FIGS. 2 and 3). First body 12 also has a first body base seal 22 (preferably a square ridge) essentially circumscribing and bound to a portion of the internal surface of the base of the first body 12 in general proximity to the first body base edge 18. First body base seal 22 connects with the first body internal seal 20 (see FIG. 4). Second body member 14 has a second body edge 24, a second body base edge 26, and a second body base seal 28 which similarly circumscribes and is similarly bound to a similar portion of the internal surface of the base of the second body 14 as the first body 12 and in general proximity to the second body base edge 26. Internal seal 20, base seals 22 and 28 may be constructed of any suitable material (eg. rubber origin) that is capable of sealing off the atmospheric air.

First body 12 and second body 14 are pivotally combined by means of hinge assembly, generally illustrated as 30, (see FIG. 3), having a pivotation post 32 with a bifurcated or slotted end 34 and an L-shaped hinge 36 having an end 37 pivoting within the bifurcation or slot of the pivotation post 32. Pivotation post 32 is bound to the second body member 14 in proximity to the periphery of the second body edge 24 and end 37 of L-shaped hinge 36 attaches to the first body member 12 over the rectangular ridge seal 20 to aid in increasing the rigidity of connecting point at the base end 37 of the L-shaped hinge 36 to the first body member 12. A clamp 40 secures the base of the cover 10 around the turbine ventilator 11 or the like.

With continuing reference to the drawings for operation of the invention, the pivotally connected via hinge assembly 30 first body member 12 and second body member 14 are opened for positioning around the turbine ventilator 11. After positioning, second body edge 24 is flushed against the rectangular ridge seal 20 (see FIG. 3) in an abutting relationship so first body member 12 and second body member 14 enclose the ventilator 11; and subsequently, base seals 22 and 28 are compressed against the base of ventilator 11 to seal same off from atmospheric air and the weather in general. Clamp 40 may be added to additionally secure the base of the cover 10 around ventilator 11.

While the present invention has been described herein with reference to particular embodiments thereof, a latitude of modifications, various changes and substitutions are intended in the foregoing disclosure, and it will be appreciated that in some instances some feature of the invention will be employed without a corresponding use of other features without departing from the scope of the invention as set forth.

We claim:

1. A cover for covering a turbine ventilator or the like comprising a cover body having a base; said cover body including a first body member having a first body edge and a first body base edge, and a second body member having a second body edge and a second body base edge; a first body internal seal generally traversing and bound to a portion of the internal surface of said first body in proximity to the periphery of said first body edge; a first body base seal essentially circumscribing and bound to a portion of the internal surface of the base of said first body in general proximity to said first body base edge; a second body base seal similarly circumscribing and similarly bound to a similar portion of the internal surface of the base of said second body as said first body and in general proximity to said second body base edge; said first body member when combining with said second body member to enclose said turbine ventilator or the like to protect same from the weather having said second body edge contacting said first body internal seal, and said first body base seal and said second body base seal joining together to essentially seal the base of the cover body to the base of the turbine ventilator or the like.

2. The cover of claim 1 wherein said first body member and said second body member are pivotally attached to each other.

3. The cover of claim 2 additionally comprising a pivotation post bound to said second body member in proximity to the periphery of said second body edge, said pivotation post including a structure having an end defining a bifurcation, a generally L-shaped hinge member having one end bound to said first body member and another end pivoting within said bifurcation of said pivotation post.

4. The cover of claim 3 wherein said first body internal seal has a structure defining a rectangular ridge, said second body edge flushing against said rectangular ridge in an abutting relationship when said first body member and said second body member are combined to enclose said turbine ventilator or the like.

5. The cover of claim 4 wherein said L-shaped hinge member attaches to said first body member over said rectangular ridge seal to aid in increasing the rigidity of connecting point of the L-shaped hinge to the first body member.

6. The cover of claim 5 wherein said first body base seal and said second body base seal, each include a structure generally defining a square ridge, said first body base seal connecting with said first body internal seal.

7. The cover of claim 6 additionally comprising a clamp member for securing said base of said cover body around said turbine ventilator or the like.

* * * * *